United States Patent [19]

Hanus

[11] Patent Number: 4,930,680

[45] Date of Patent: Jun. 5, 1990

[54] ONE PIECE CONTAINER WITH FOLDABLE TOP CLOSURE AND BLANK THEREFORE

[76] Inventor: John P. Hanus, 3509 N. 64th St., Milwaukee, Wis. 53216

[21] Appl. No.: 380,149

[22] Filed: Jul. 14, 1989

[51] Int. Cl.[5] ..... B65D 5/24

[52] U.S. Cl. ..... 229/110; 229/8; 229/138; 229/186

[58] Field of Search ..... 229/8, 41 C, 109, 110, 229/138, 186, 922, 923, 40; D9/331, 414, 430, 431, 452

[56] References Cited

U.S. PATENT DOCUMENTS

| | | | |
|---|---|---|---|
| D. 270,042 | 8/1983 | Fisher | D9/430 |
| D. 272,130 | 1/1984 | Miyazaki | D9/431 |
| 2,013,691 | 9/1935 | Martinson | 229/40 |
| 2,160,488 | 5/1939 | Ringler | 229/138 |
| 3,423,008 | 1/1969 | Mykleby | 229/186 |
| 3,833,113 | 9/1974 | Osier | 229/103 |
| 4,185,767 | 1/1980 | Sykora et al. | 229/138 |
| 4,260,101 | 4/1981 | Webinger | 229/101 |
| 4,705,209 | 11/1987 | Fujihara et al. | 229/186 |
| 4,795,082 | 1/1989 | Fujihara et al. | 229/8 |

*Primary Examiner*—Gary Elkins

*Attorney, Agent, or Firm*—Foley & Lardner

[57] ABSTRACT

A bowl shaped container having a polygonal shaped bottom section; rectangular, square, or trapizoidal side sections; and top closure material which folds down in a spirling fashion, which may or may not lock, included in the design. The container will be preferably formed from a single sheet of foldable material, which, through a unique folding process, creates the bottom, side panels and top closure. The description defines an open bowl shaped polygonal container with top covering material which folds down toward the center of the top of the container in a generally spiral fashion. The container provides a receptacle which can be closed through a folding action, and can be reopened to the near flat state again without great effort.

10 Claims, 6 Drawing Sheets

ONE PIECE CONTAINER WITH FOLDABLE TOP CLOSURE AND BLANK THEREFORE

BACKGROUND OF THE INVENTION

1. Field of the Invention

The invention relates to containers and more specifically to containers fabricated from blank material scored into a plurality of shapes suitable for assembly into the shape of a container.

2. Description of the Prior Art

The prior art is replete with articles fabricated from scored material facilitating foldability along the weakened lines of materials. An interesting container is shown in U.S. Pat. No. 256,219 which discloses a container fabricated from a foldable material into a shape having a top which folds into a spiral shape. An earlier U.S. Pat. No. 727,723 issued May 12, 1903, discloses a folding box having a spiral shaped top which can be opened and closed. Still another U.S. Pat. No. 3,833,113 issued Sept. 3, 1974, describes a container having a polygonal bottom connected to a plurality of rectangular side panels connected to and separated by groups of triangles. The container is collapsible to provide a plate-type receptacle for eating and the like.

While many receptacles of the type briefly discussed above may be found in the prior art, none appear able to simultaneously provide the functions of nesting of a multiplicity of containers before use, the locking of the container type once the container is filled, and the expansion to a container adopted for use as a plate or the like.

SUMMARY OF THE INVENTION

In accordance with one embodiment of the present invention, a blank of material having sufficient integrity to hold food stuffs and the like is scored into a unique plurality of fold lines which enable the blank to be folded into a bowl shaped container having sufficient integrity to retain its shape for nesting a multiplicity of such containers prior to storing substances therein. Once the containers have received products for storage, the container is assembled through further folding along the unique combination of fold lines into a locked container having a bottom, side and top panels. The container may also be opened and expanded into a dish or bowl-like receptacle for access to the products such as may be desirable in a fast food restaurant or the like.

Other objects and advantages of the container of the present invention will be readily apparent from the following description to be read with the accompanying drawings wherein like reference characters refer to the same or similar parts throughout the several views.

DETAILED DESCRIPTION OF EXEMPLARY EMBODIMENTS

Figure 1:
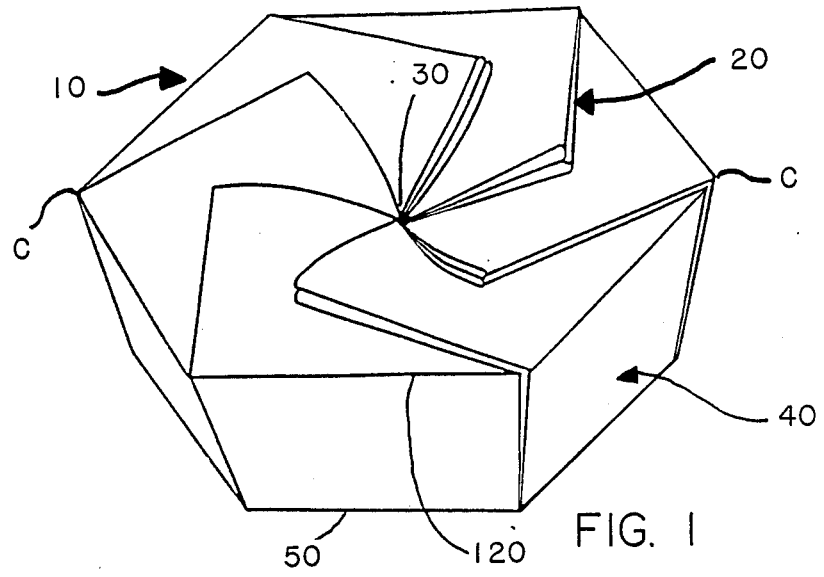
FIG. 1 is a perspective view of a closed and locked container in accordance with one embodiment of the present invention.
Figure 2:
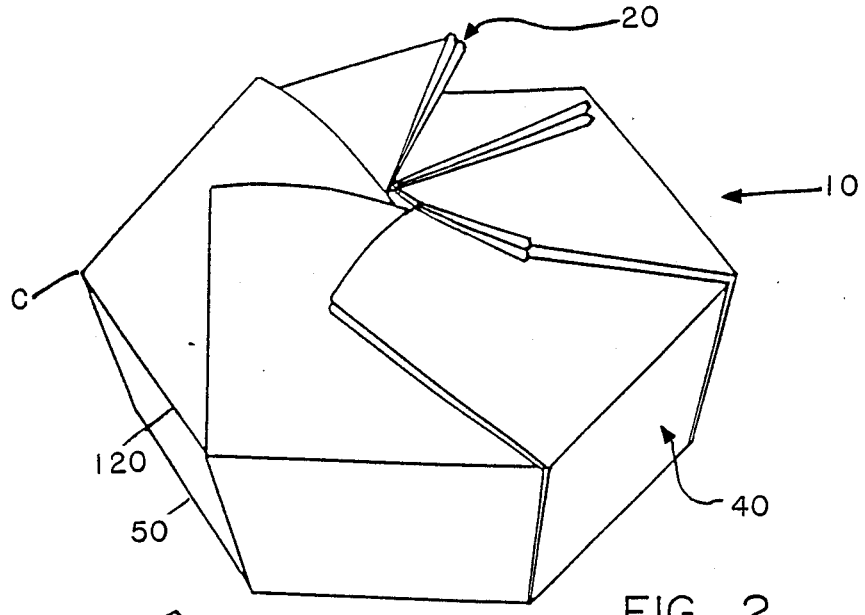
FIG. 2 is a perspective view of the container of FIG. 1 in a closed but unlocked state.
Figure 3:
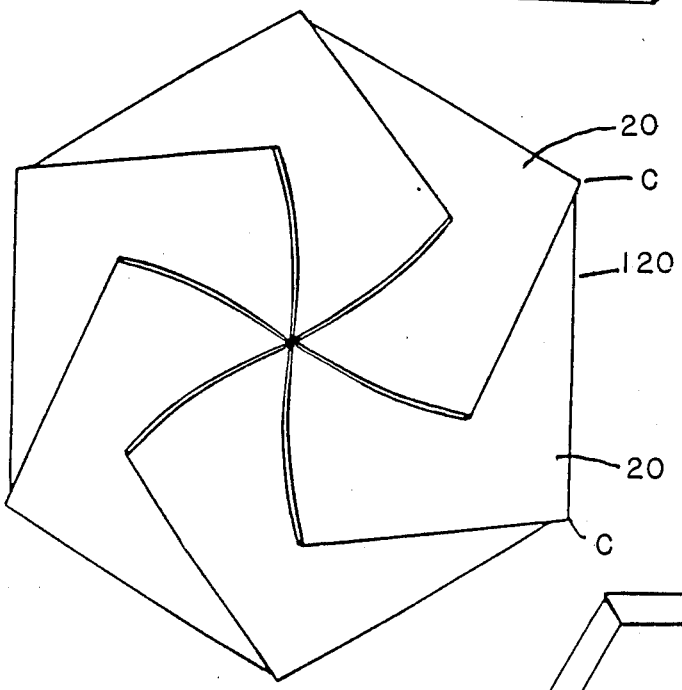
FIG. 3 is a top view of the container of FIG. 1.
Figure 4:
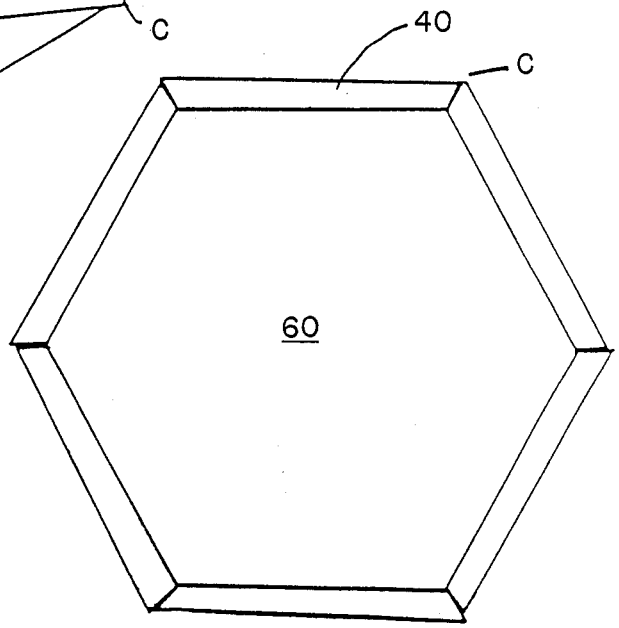
FIG. 4 is a bottom view of the container of FIG. 1.
Figure 6:
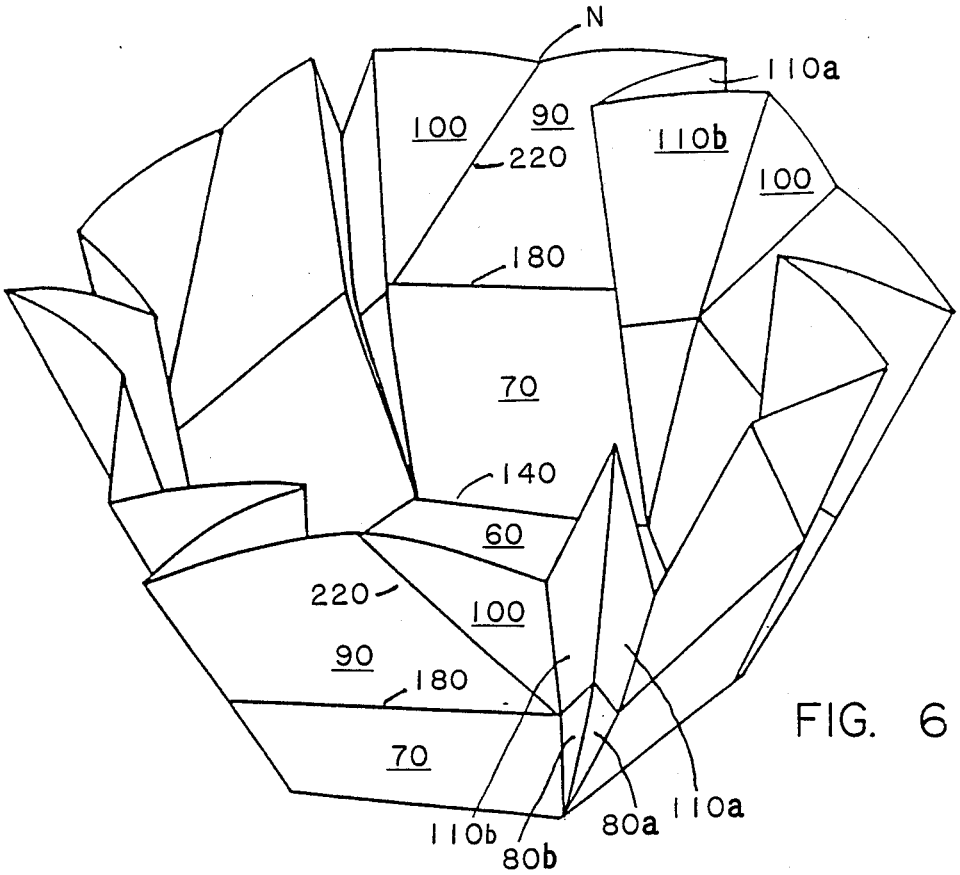
FIG. 6 is a perspective view of the container of FIG. 1 in an open configuration illustrating the various fold and panel relationships prior to assembly into the configuration of FIG. 5.

Reference is made to FIGS. 1 through 4 in order to briefly describe the external appearance of a container made in accordance with one embodiment of the invention in which the container is in an essentially closed configuration sometimes called the "second stage". FIGS. 1, 3, and 4 represent the locked configuration of a container 10. The top of container 10, noted generally by numeral 20, is arranged in a spiral appearing configuration caused by the interleaving of panels which are hingedly connected to panels forming the sides of container 10 generally noted by character numeral 40. The top portion of side 40 is folded toward the center 30 forming a top edge 120. Side 40 also is hingedly connected to a single bottom panel 60 as best seen in FIG. 4, forming edge 50. FIG. 2 illustrates container 10 immediately prior to pressure being applied to top 20 to lock the panels in place. A comparison between FIGS. 1 and 2 demonstrates that top 20 in FIG. 1 is depressed slightly below the horizontal plane across edge 120, particularly in the region about center 30. In FIG. 2, top 20 is generally positioned above the same horizontal plane. The locking feature of the container of the present invention will be described in more detail below.

Figure 8:
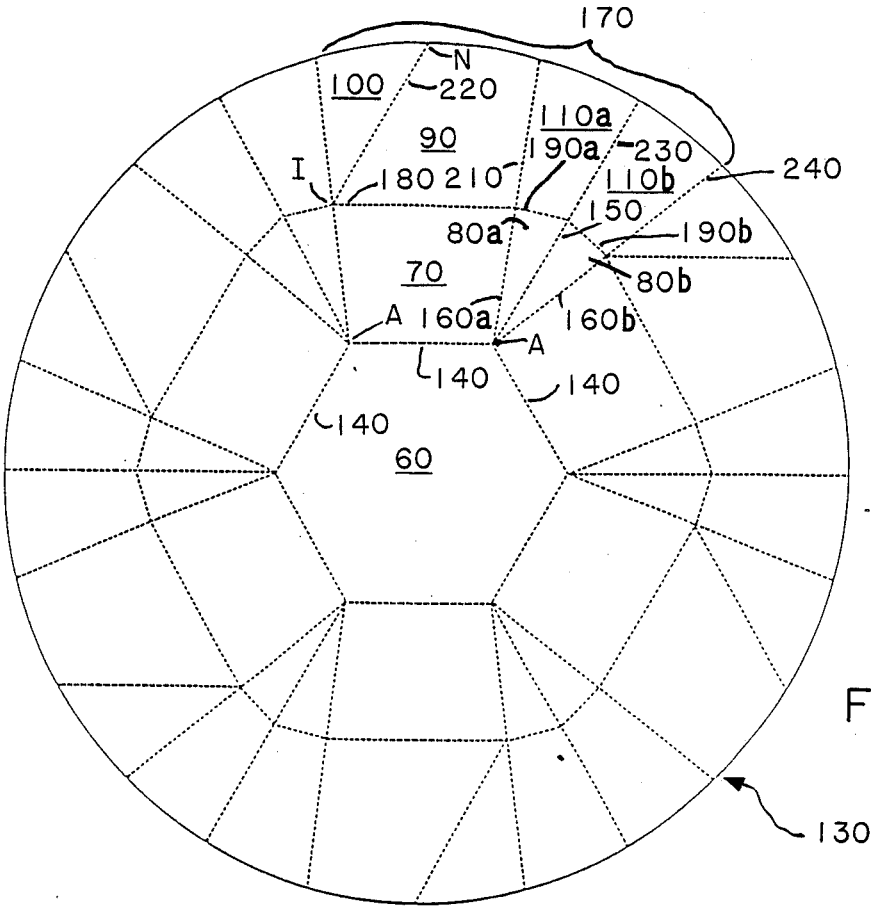
FIG. 8 is a top plan view of a blank of material with dotted lines indicating folding lines which may be assembled into the container of FIG. 1.

As illustrated in FIG. 8, container 10 is assembled from a blank 130 which is scored, i.e., the material is weakened, as illustrated by the various dotted lines, to provide fold or scored lines for assembly into the various stages. Viewing blank 130 from its center to its periphery, it may seem that the blank is actually separated by the fold lines into 3 groups of polygonal or polygonal-type shapes. The first group comprises bottom panel 60 illustrated, by way of example only, as a hexagon. Bottom panel 60 is defined by a plurality of fold lines indicated by character numeral 140.

The second group, which when assembled forms side 40 of container 10, is comprised of a plurality of quadrangles 70 which are connected to bottom panel 60 along fold lines 140 and a plurality of paired triangles **80*a* and 80*b* connected to each other along fold lines 150 to adjacent quadrangles 70 along respective fold lines 160*a* and 160*b*, and to bottom panel 60 at point A on fold line 140. Thus, the second group essentially circumscribes bottom panel 60**.

A third group of panels which, when container 10 is assembled, comprises top 20 thereof, essentially circumscribes the second group and forms periphery, denoted by the character P. In the embodiment illustrated in FIG. 8, blank 180 of container 10 is set forth in the form of a circle although other peripheral configurations may be employed as desired. The third group of panels may be visualized as being further broken down into a subset of panels noted by numeral 170 and accompanying bracket. Each subset 170 includes a panel member 90, an associated triangularly shaped panel 100 and an associated pair of second panels 110*a* and 110*b*. As shown in this embodiment, the third group of panels contains six subsets 170, or one subset for each side of panel 60. For clarity, this subset frequency will also hold true for the second group of panels.

Each panel member 90 shares a common fold line 180 with a quadrangle 70, a common fold line 210 with an associated panel 110*a*, and a common fold line 220 with associated panel 100.

Panels 110*a*, 110*b*, respectively, share a common fold line 190*a*, 190*b* with triangle panels 80*a* and 80*b*. Fold line 230 separates each associated panel 110*a* and 110*b*. Panel 110*b* also shares a common fold line 240 with a panel 100 of an adjacent subset 170.

Again, in reference to FIG. 8, it may be seen that fold lines 150 and 230 are actually segments of a single fold line lying essentially on a line which originates at point A. Similarly, fold lines 160*a*, 210 and 160*b*, 240 are respective segments of single fold lines. All of the lines diverge from an apex noted by the letter A formed by the intersecting fold lines 140 of panel 60. The divergence is essentially uniform and further defines the essentially scalene configuration of triangle panel 80*a* and 80*b*. It may be seen that panels 80*a* and 80*b* and also panels 110*a* and 110*b* are essentially mirror images of each other.

Figure 5:
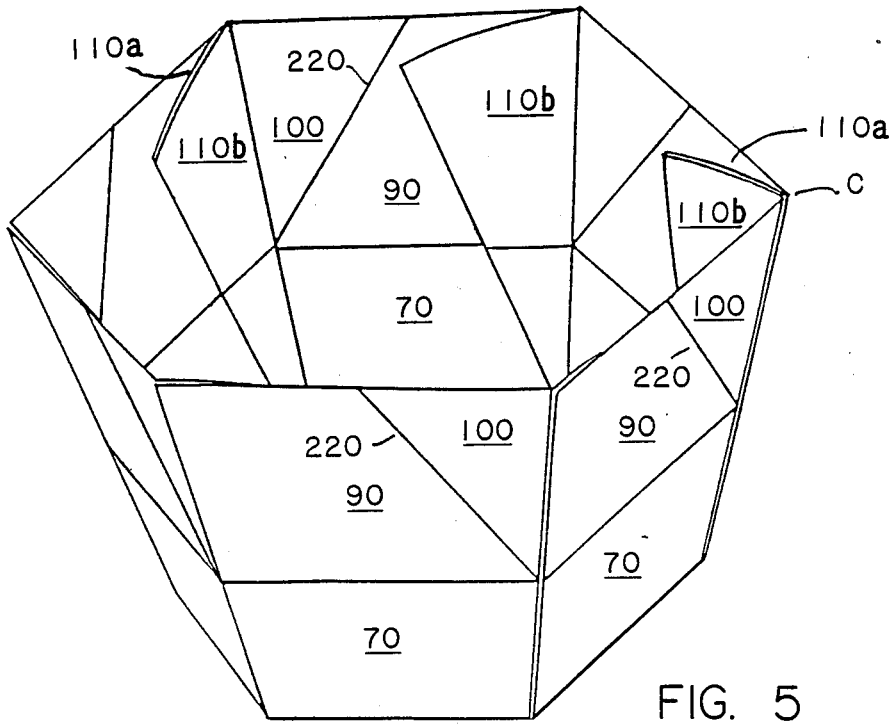
FIG. 5 is a perspective view of the container of FIG. 1 in an open configuration suitable for stacking.

First stage assembly of container 10 is best viewed in FIG. 5 which illustrates the assembly of an "erect-but-open" stage suitable for nesting a plurality of containers 10 before materials are received for storage therein. In this stage, all of the second and third group panels have been folded upward along fold lines 140. To accomodate this upward folding, inward movement of panels 80*a*, 110*a* and 80*b*, 110*b* occur due to folding primarily along fold lines 150 and 230, 210 and 160*a*, 240 and 160*b*. Because of the essentially mirror image relationship between panels 80*a* and 80*b* and panels 110*a* and 110*b*, the respective panels are able to fold on top of one another. Thus, the extended fold lines 160*a*, 210 and 160*b*, 240 are able to, in effect, contact each other when the container is in the "erect-but-open" stage best depicted in FIG. 5. As illustrated therein, all panels of the second group have been erected, with the panels 80*a* and 80*b* abutting and folding on top of each other and panels 110*a* and 110*b* of the third panel group lying basically in the same vertical plane as panels 80*a* and 80*b*.

The folds so described above provide suitable integrity for stacking or nesting prior to use. As is readily apparent, counter space is at a premium and the ability to nest the containers is an extremely desirable feature in any kitchen or counter area typified by the fast food restaurant. The resistance provided by the additional folds precludes undesirable return to a flatter configuration which would occupy greater horizontal space. Alternatively, or in addition to the aforementioned resistance, strategic placement of an adhesive or hot sealing of certain panel surfaces may be accomplished in the assembly of the blank 130 into the "erect-but-open" stage to provide further stability. For example, adhesive could be placed between the outwardly abutting surfaces of triangles 110*a* and 110*b* and/or between 110*a* and the inside of panel 90.

Figure 7:
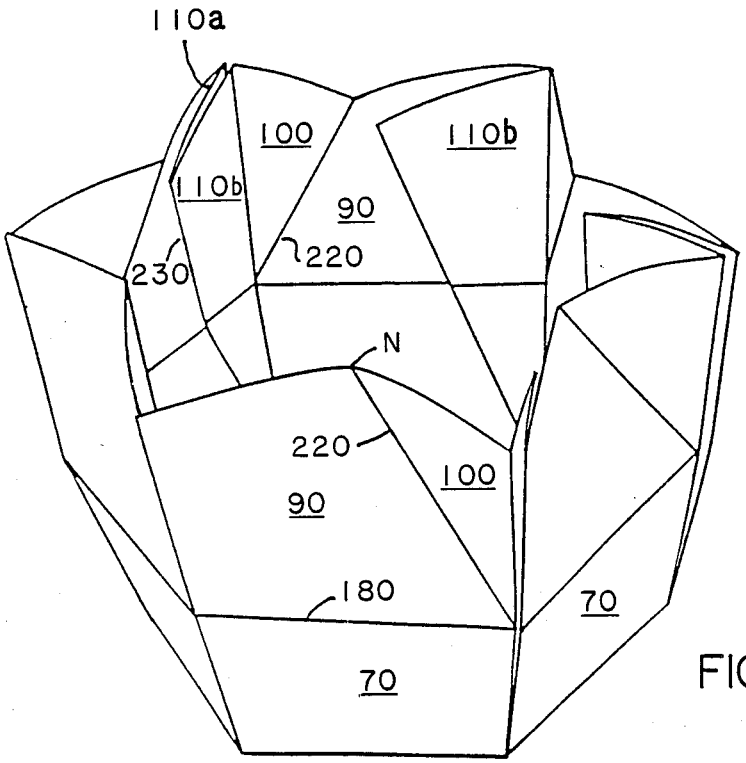
FIG. 7 is a perspective view of the container of FIG. 1 in a configuration slightly more closed than the configuration of FIG. 6.

Second stage assembly involves the folding of the third panel group comprising top 20 about the container edge 120 as illustrated in FIG. 1. FIG. 7 shows container 10 in the process of being folded into the closed container from the open but erected stage of FIG. 5, further illustrating the interaction of the various fold lines as top 20 is being closed.

Figure 10:
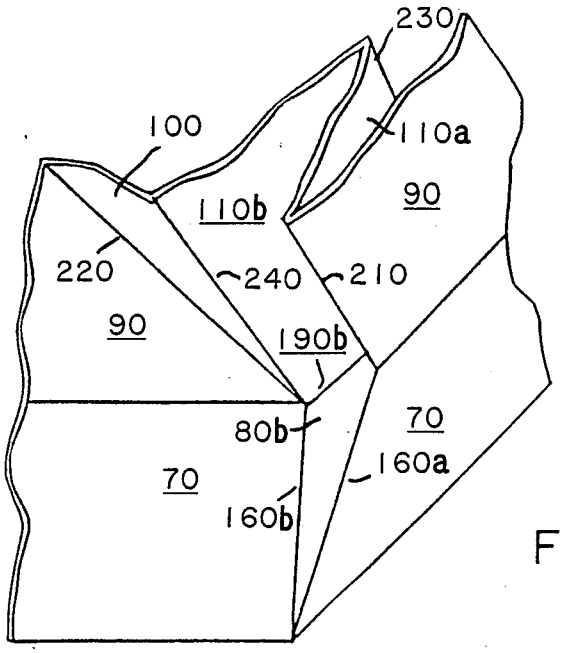
FIG. 10 is an enlarged perspective view of a portion of the container of FIG. 1 as the top members thereof are being folded into a closed position.
Figure 11:
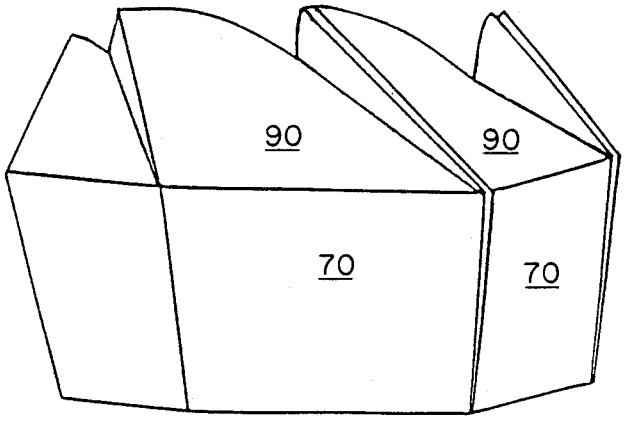
FIG. 11 is a view similar to that of FIG. 10 in which the top members are folded into a nearly closed position.

From FIG. 10, which is an isolated and enlarged view of the action of the overlapping panel members 110*a* and 110*b*, their relation to each other as container 10 is folded to the closed stage may be appreciated. It may be seen that fold lines 190*a* and 190*b*, when acted upon in closing, will allow the portion of the panel members 110*a* and 110*b* to collapse inward toward the center 30 of the container 10. As best seen in FIG. 8, fold line 220 starting from the point of intersection of fold lines 180, 190*b* and 240 running to a point N on periphery P of blank 30 represents an inside fold in that it will fall inward toward center 30 of container 10 as top 20 is closed. In the process of closing the container, the points N of each subset 170 of the third group of panels approach each other near the center vertical axis of container 10.

As perhaps best seen in FIG. 2, a 'locking' feature can be engineered into container 10. When the container is caused to be closed, the material of panels 90 and 100 in the vicinity of points N will begin to press against each other before the panels become flat in configuration, i.e., reach a horizontal configuration. With continuing downward pressure applied to the top of the container, having the effect of pushing the adjacent panels beyond the critical or highest tension point, past which the tension is relieved, the container will in effect 'lock' and have resistance to reopening. At this point, the folded top, as shown in FIG. 1, will remain in the closed and 'locked' position until external or internal force is applied. The locking feature is provided by ensuring that the distance from the point of intersection, at which fold line 220 starts to its terminus at the periphery P, is greater than the horizontal distance measured from corner C of container 10 to a vertical axis through center 30.

Thus, in the closed or locked stage of container 10, panels 90 form the visible exterior surface of top 20 when viewed as illustrated in FIG. 3. Pressed against the interior surface of each panel 90, and largely hidden from view except at the edge thereof, is the outwardly facing surface of an associated panel 110*a*. In like manner, the outwardly facing surface of associated panel 110*b* is folded against the now inwardly facing surface of 110*a*. The associated panel 100 fold so as to face the outward facing surface of its associated panel 90*a*, in an abutting relationship, but is hidden from view due to the overlap or interleaved relationship of an adjacent panel 90.

Figure 12:
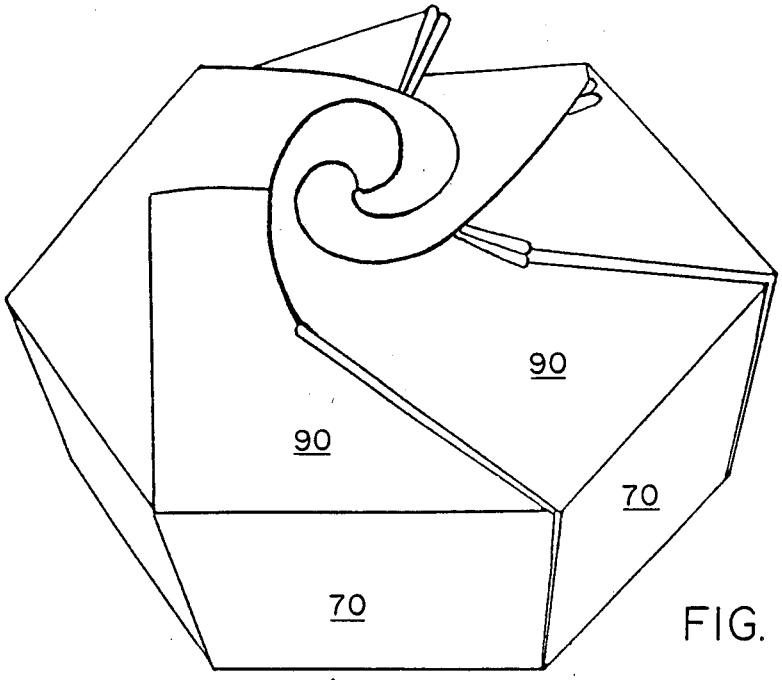
FIG. 12 is a perspective view of a container similar to that in FIG. 1 with a different locking feature.
Figure 13:
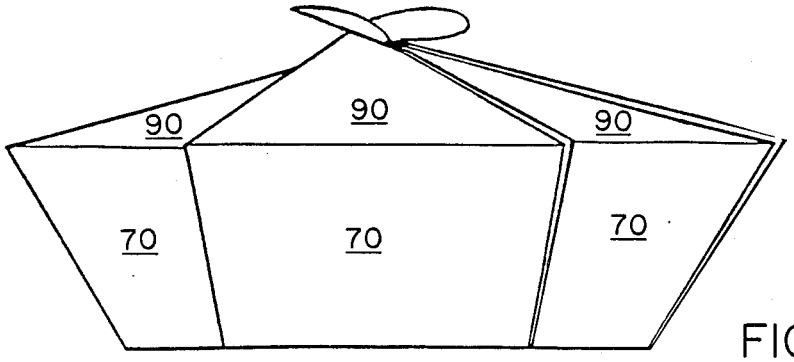
FIG. 13 is a side view of the container illustrated in FIG. 12.

Still other locking features may be employed, including interlocking tabs illustrated in FIGS. 12 and 13. As seen therein, some or all of the panel members 90 may be provided with a spiraling arm or other such design which interleaves thus providing a domed or raised top configuration which resists opening.

Figure 9:
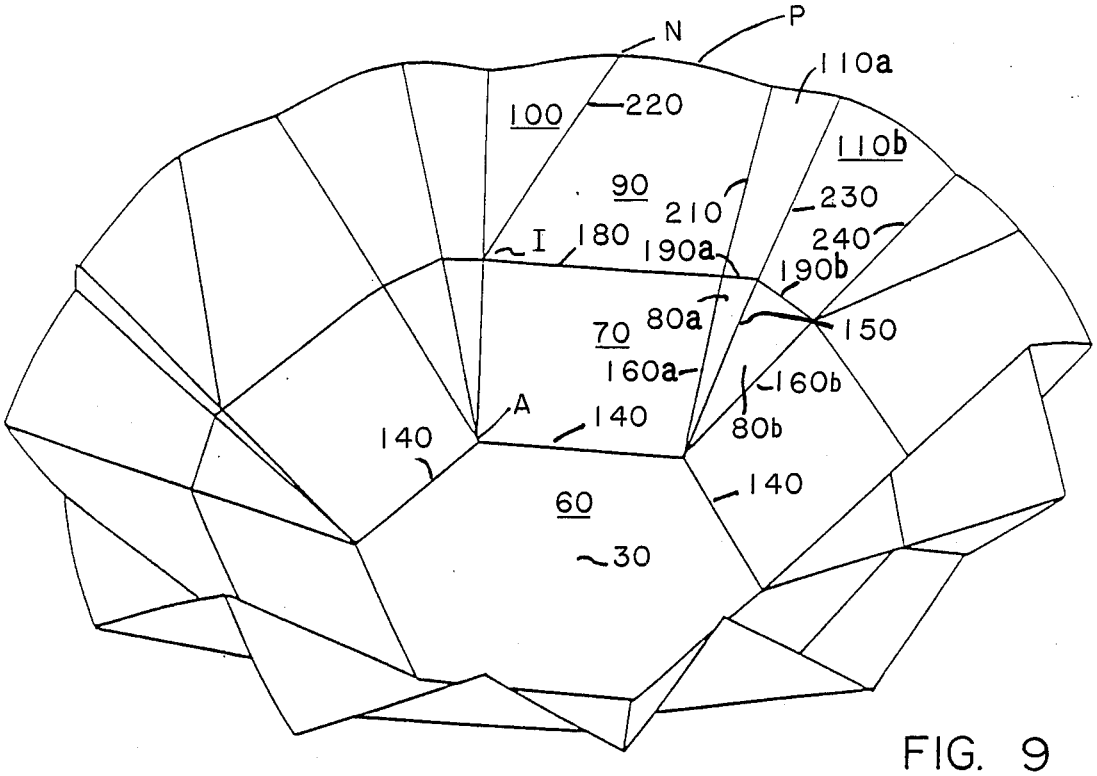
FIG. 9 is a perspective view of the container of FIG. 1 expansively opened after being assembled into a locked container and adapted for use as a bowl or other retainer-like article.

The third stage or open stage of the invention is illustrated in FIG. 9 and involves pulling up on one or more of the folded panels which form the spiral shaped top 20 of closed container 10. In accomplishing this, container 10 will open first to the erect-but-open stage and with continued expansion, will cause panel members 110*a* and 110*b* to pull away from their position against the interior wall of the container and open into a flat or near flat state from which the blank was formed. Because of the resistance of the folds, the form the container will generally take will be that of a bowl of much larger diameter than the bowl created in the 'erect-but-open' stage shown in FIG. 5, and will have resistance to achieving a perfectly flat state due to the action of the creases which were formed into the blank.

It can be seen that a polygonal container, which could be designed to be nestable, constructed of foldable material, can be assembled through a unique configuration of folds upon a flat blank which include a series of polygonal or polygonal-type segments which relate to each other in such a way that each segment and fold thereof is dependent on the adjacent segment and fold, and which when filled, can be closed and locked and upon reopening, be unfolded to a flat or near flat state.

It should be understood that the invention described herein could be used to construct a polygonal container of any number of sides, 4 or more, without affecting the scope of the invention. The 6 sided container shown in the description is used only by way of an example. Similarly, the precise shapes of the described panel may be varied. For example, quadrangles 70 may be rectangular, square, or trapezoidal in configuration. Other and different modifications and changes will become apparent upon reading of the foregoing description, claims and drawings thus fabricated by those skilled in the art without departing from the scope and spirit of the appended claims.

I claim:

1. A blank sheet of material having a multiplicity of scored lines which divide said sheet into a multiplicity of panels permitting said sheet to be folded along said scored lines into a container, said panels being arranged into groupings of panels including:

(a) center shape having at least four sides;

(b) a first group comprising a plurality of polygonal shaped panels essentially circumscribing said center shape, said first group including a plurality of quadrangles each sharing a common scored line with said center shape, said quadrangles separated by at least two triangles which share respective common scored lines with said quadrangles; and (c) a second group of polygonal shapes essentially circumscribing said first group and having sides which collectively form an outer periphery of said blank, said second group including:

(i) a plurality of first members each sharing a common scored line with a first side of said quadrangles and each having an other side coextensive with a line extending outwardly from a second side of said quadrangles, (ii) a triangularly shaped member associated with each of said first members and comprising a pair of sides diverging from a point of intersection, one of said pair of sides being common to a side of an adjacent first member and the other of said pair of sides being coextensive with a line extending outwardly from a third side of said quadrangles, and (iii) at least two second members, one having a common scored line with an adjacent triangularly shaped member and a common scored line with an adjacent triangle and the other having a common scored line with an associated first member and a common scored line with an adjacent triangle.

2. The blank sheet of claim 1 in which said triangularly shaped members essentially are scalene triangles.

3. The blank sheet of claim 2 in which said triangles are essentially mirror images of each other.

4. The blank sheet of claim 3 in which said second members are essentially mirror images of each other.

5. The blank sheet of claim 1 in which said point of intersection is defined by an intersection of said scored line common to said first member and said quadrangle and said scored line common to said quadrangle and an adjacent triangle.

6. A closed container formed of a foldable material comprising:

(a) a bottom in the shape of a polygon;

(b) a side integral to a periphery of said bottom and having a plurality of side panels equal in number to the number of sides of said bottom, each of the adjacent side panels separated by a plurality of triangle members integral to said side panels and folded against each along an interior surface of said side panels; and (c) a top integral to said side along an upper periphery of said side for enclosing said container, said top including:

(i) a plurality of top panels folded along a line of connection to said side panels toward a central vertical axis of said container, (ii) a triangular shaped member connected to and associated with each of said top panels, said triangularly shaped member having an inner facing surface abutting an outward facing surface of said associated top panel, (iii) at least a pair of second members associated with each top panel, one of said pair having an outward facing surface abutting an inward facing surface of said associated top panel, said other of said pair having an outward facing surface abutting an inward facing surface of said one of said pair.

7. The container according to claim 6 in which each of said associated triangular shaped members abuts and is substantially covered by an inward facing surface of an adjacent top panel.

8. An intermediary nesting container formed from a blank and closable into a closed container comprising:

(a) a bottom in the shape of a polygon;

(b) a side integral to the periphery of said bottom and having a plurality of side panels equal in number to the number of sides of said bottom, each of the adjacent side panels separated by a plurality of triangle members integral to said side panels and folded against each along an interior surface of said side panels; and (c) a plurality of panels hingedly connected to said side panels and triangle members, said plurality of panels including:

(i) a plurality of first panels extending essentially vertically upward from the line of connection to said side panels, (ii) a plurality of first members connected to and associated with each of said first panels, said first members extending essentially vertically upward from a point of intersection with said side panels, (iii) at least a pair of second panels associated with each of said first panels and each of said first members, one of said pair of second panels hingedly connected to said associated first panel member and other of said pair of second panels hingedly connected to said adjacent first member.

9. The intermediary nesting container of claim 8 in which the essentially vertical extension of said first panels is maintained by the presence of adhesion between said triangle members.

10. The intermediary nesting container of claim 9 in which the essentially vertical extension of said first panels is maintained by the presence of adhesion between said pairs of second panels.

* * * * *